US006067677A

United States Patent [19]

Reen et al.

[11] Patent Number: 6,067,677

[45] Date of Patent: May 30, 2000

[54] CRIB SHEET

[76] Inventors: Marie Theresa Reen, 17 Glendale Rd.; Charlene Marie Reen, 70 Valley Rd., both of Norwood, Mass. 02062

[21] Appl. No.: 09/418,803

[22] Filed: Oct. 15, 1999

Related U.S. Application Data

[60] Provisional application No. 60/104,812, Oct. 19, 1998.

[51] Int. Cl.[7] ..... A47G 9/04

[52] U.S. Cl. ..... 5/499; 5/496; 5/497

[58] Field of Search ..... 5/499, 496, 497, 5/490, 495, 498, 923, 420

[56] References Cited

U.S. PATENT DOCUMENTS

| | | | |
|---|---|---|---|
| 2,446,396 | 8/1948 | Waranch | 5/490 |
| 3,066,323 | 12/1962 | Kintner . | |
| 3,832,743 | 9/1974 | Smith . | |
| 4,488,323 | 12/1984 | Colburn | 5/496 |
| 4,651,371 | 3/1987 | Hahn | 5/497 |
| 5,291,625 | 3/1994 | Leslie | 5/420 |
| 5,430,902 | 7/1995 | Lewis | 5/490 |
| 5,566,410 | 10/1996 | Schaechter | 5/490 |
| 5,642,540 | 7/1997 | Culver et al. | 5/499 |

*Primary Examiner*—Alexander Grosz
*Attorney, Agent, or Firm*—D. Michael Burns

[57] ABSTRACT

A sheet designed to cover a crib mattress, in a way in which a child will not be able to unravel the sheet, thereby creating a potential safety hazzard to the child. The present invention comprises a casement style sheet that completely covers the entire mattress. It slides onto the mattress through an opening in one end of the sheet. The perimeter of the opening having a continuous elastic band disposed therein, thereby allowing the sheet to fit tightly and tautly over the mattress without any snagging. The sheet is secured by a flap, which is integrally attached to the open end of the sheet, and is pulled over the encasement opening whereby it is then secured by hook and loop closure means.

15 Claims, 3 Drawing Sheets

CRIB SHEET

CROSS REFERENCE TO RELATED APPLICATION

This application is based on Provisional Patent Application Ser. No. 60/104,812 filed on Oct. 19, 1998.

BACKGROUND OF THE INVENTION

1. Field of the Invention

The present invention relates to a crib sheet with special sheet construction and means for securing it onto a crib mattress. One aspect of the invention relates to a safety crib sheet having an elastic retaining seam with adjustable and releasable fasteners.

2. Description of the Prior Art

The predominate crib sheet of the prior art consists of a sheet of fabric covering the top of the crib mattress and held on the mattress by sheet corners that have elastic sewn into their corners. Independent studies such as those conducted by the American Society for Testing and Materials (ASTM) have confirmed that even an infant of twelve pounds can pull off most of the prior art crib sheets from the mattresses they cover. The Textiles department of the Good Housekeeping Institute, which is an independent testing laboratory confirmed in their November 1998 issue that most of the crib sheets manufactured today will not fit properly after as few as five washings. Since 1973 all manufacturers of crib mattresses, sold in the United States, have had to conform to a size standard, but this is not the case when pertaining to crib sheets, as there are no set standards. The greatest danger of a crib sheet that has shrunk, or which was too small to begin with, is they easily pop off the corners of the mattress. This can lead to tragic situations wherein a child can become entangled amidst the unraveled sheet.

There is an obvious great need for a crib sheet that cannot be easily pulled off the mattress by the child. There are many attempts to provide a solution to this problem. Various types of fasteners have been suggested including zippers, buttons, releasable fasteners, hook and loop types as marketed under the trade name "velcro". Parents must be able to purchase a crib sheet with peace of mind that the crib sheet will be safe. All the problems that exist with contoured corners of the prior art sheets, such as shrinkage, variations in size from one supplierto another, shoddy materials, and improper manufacturing techniques have created a long felt need for a safer crib mattress sheet. The present invention introduces an improvement and a solution for the above problems.

A patent that teaches the use of a pillow type encasement over a pad is U.S. Pat. No. 5,642,540 issued to Culver et al. on Jul. 1, 1997. One embodiment of Culver et al. discloses a cover configured to encase a pad (possibly a mattress) and discloses a button type fastener, but they also suggest that a hook and loop fastener, such as Velcro, could also be used. In the claimed embodiment, he teaches the folding of a flap underneath the sheet panel, thus having a mattress cover without any fasteners. This also will allow the pad to be reversible. Whereas this patent refers primarily to a playpen, it is appreciated that it could apply to crib mattresses as well. The key to this patent is that the cover takes the form of an encasement style cover. What this patent lacks, and which is the most important feature of the present invention, is having an elastic means sewn into an area of close proximity to the perimeter of the encasement opening to keep the sheet covering tight about the mattress. Once the sheet has been pulled over the mattress in the present invention, the encasement opening decreases significantly for safety purposes.

U.S. Pat. No. 5,566,410 issued to Schaechter on Oct. 22, 1996, teaches the use of hook and loop fasteners to provide a quick fastening method for a pillow case. These type of fasteners are used for their superior holding strength.

U.S. Pat. No. 4,651,371 issued to Hahn on Mar. 24, 1987, depicts the hook and loop fasteners on the corners of the sheet. This is the conventional method of the prior art.

U.S. Pat. No. 5,430,902 issued to Lewis on Jul. 11, 1995, teaches the construction of a pillow case which utilizes a closing flap having hook and loop fastening means to secure the flap to the bottom panel.

U.S. Pat. Nos. 4,488,323, 3,832,743 and 3,066,323 issued to Colburn, Smith and Kintner respectively, are suggestive of numerous attempts to use hook and loop fasteners to secure covers to mattresses.

None of the above inventions and Patents, taken either singly or in combination, is given to describe the instant invention as claimed, especially as the instant invention teaches the use of an elastic about the encasement opening of the sheet.

SUMMARY OF THE INVENTION

The present invention relates to a mattress covering for a child's crib. The present invention relates specifically to a sheet which is designed to be used as an encasement of the mattress, similar in manner in which a pillow case slips over a pillow. The major improvement of the present invention is found in a continuous elastic band which is disposed in a sleeve type seam and encircles the perimeter about the encasement opening of the sheet. This helps to create a taut and secure sheet covering of the crib mattress, one that a child cannot unravel. The present invention includes using a hook and loop closure method to secure a flap extending over a mattress end. Any excess material of the sheet is encased within the flap. The safety of the sheet is inherent in the design of the sheet. The elastic band encircles about the encasement opening plus the use of hook and loop fasteners, both act in concert to provide a crib sheet which cannot be unraveled by a child.

The present invention provides a crib sheet having an elastic band sewn into the seam about the encasement opening of the sheet. When the sheet is pulled over so that it completely encases the mattress, the nature of the elastic band causes it to tighten, thereby shrinking the opening and making it virtually impossible for a child to pull it off the mattress.

Accordingly, it is a principal object of the invention to provide a sheet covering for a crib mattress which cannot be unraveled by a child in a crib.

It is another object of the invention to provide a method for securing the sheet over the crib mattress, maintaining the sheet in the proper position and thereby not allowing the sheet to become dislodged by the child.

It is a further object of the invention to provide a covering for a crib mattress which will fit tautly about the mattress, and which will use hook and loop type fasteners that are easily releasable and will not prematurely wear out.

Still another object of the invention is to provide a covering for a crib mattress which is safe, relatively inexpensive, dependable, totally launderable and fully effective in accomplishing its intended purpose.

Yet another object of the invention is to provide a covering for a crib mattress that will have sufficient size to accomplish the purpose in which it is intended.

These and other objects of the present invention will become readily apparent upon further review of the followig specification and drawings.

DETAILED DESCRIPTION OF THE PREFERRED EMBODIMENT

Figure 1:
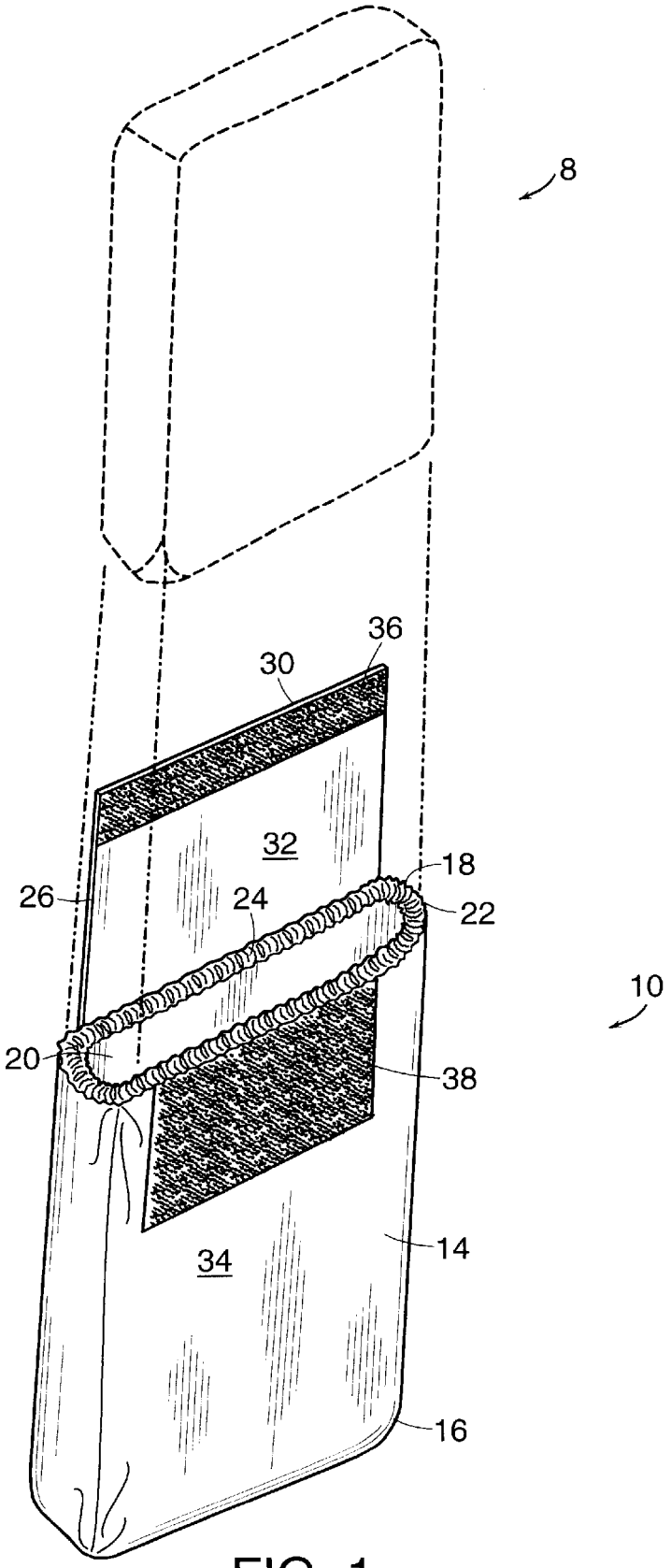
FIG. 1 is a bottom perspective view of the crib sheet, shown apart from the mattress, and with the flap open.
Figure 2:
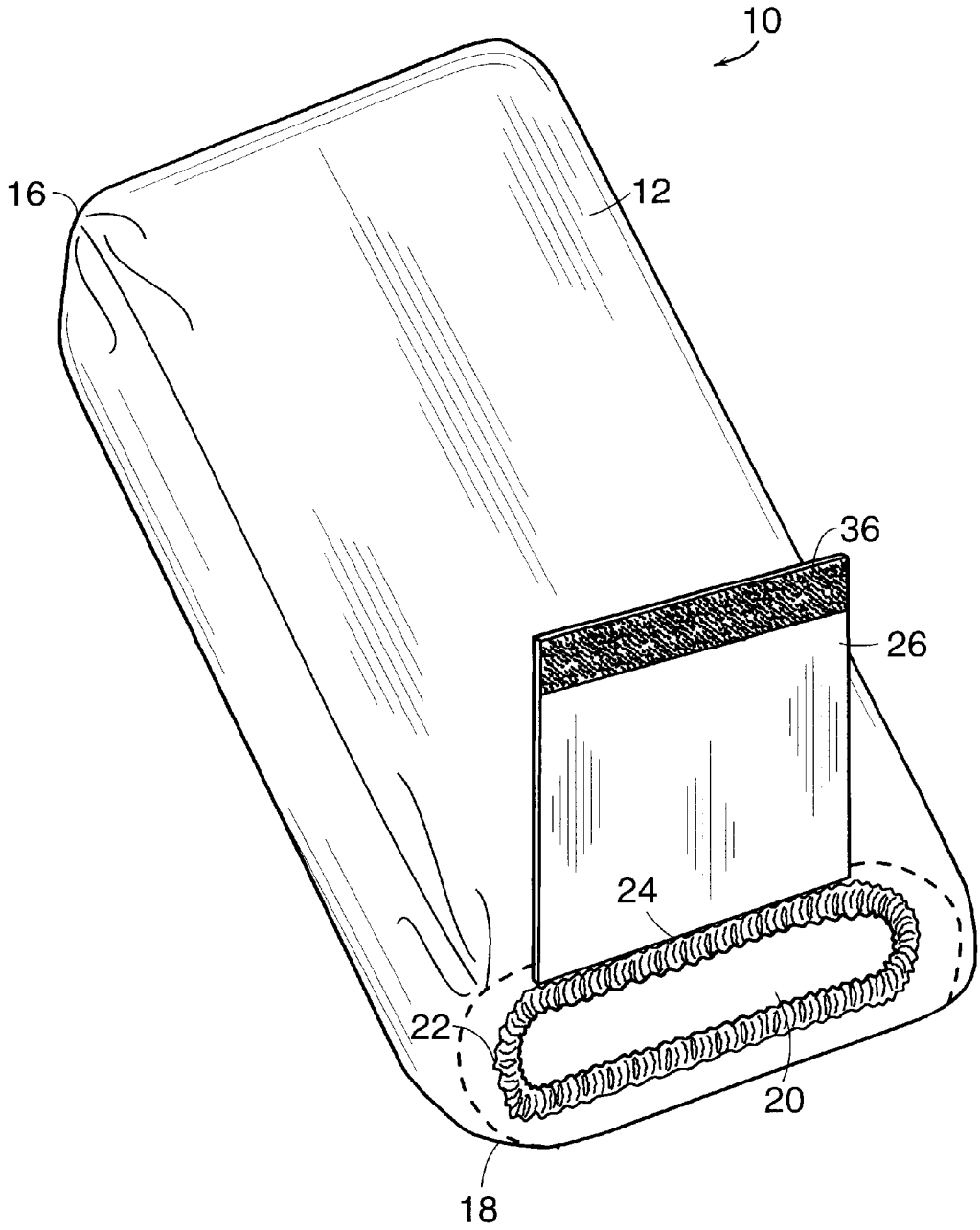
FIG. 2 is a top perspective view of the crib sheet, shown with the elastic seam exposed and the flap pulled back.
Figure 3:
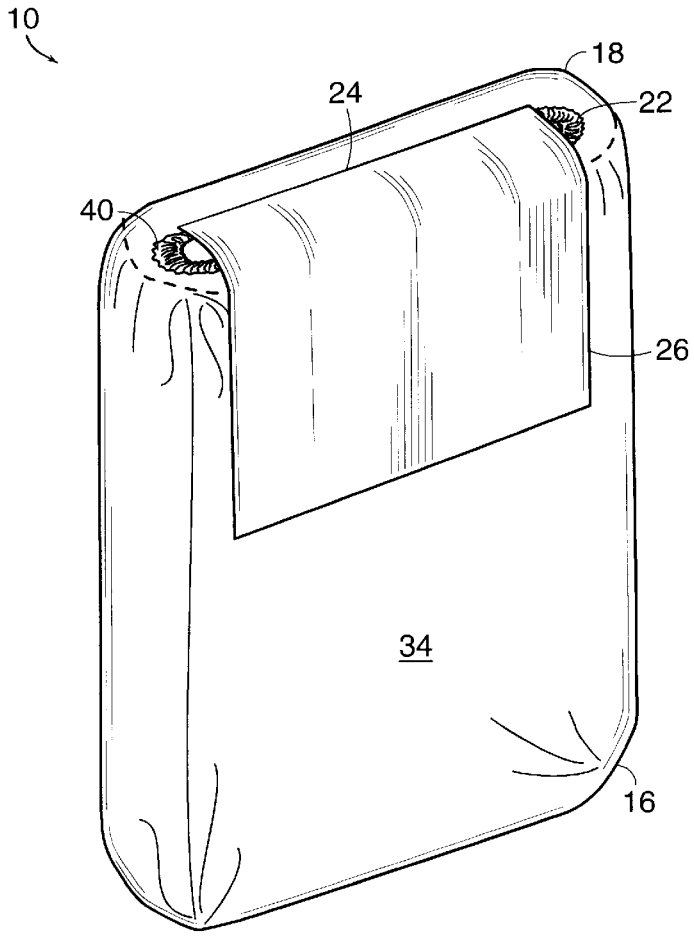
FIG. 3 is a bottom perspective view of the crib sheet, shown with the mattress inside and with the flap closed.

FIG. 1 is a bottom perspective view of a substantially rectangular crib sheet 10 for encasement about a crib mattress 8 shown apart from the crib sheet 10. The sheet 10 includes a top panel 12, shown in FIG. 2, and a bottom panel 14, which are constructed so as to encase the mattress 8 in a manner similar in which a pillow is encased within a pillow slip. The panels 12 and 14, as constructed, form a closed end 16 and an open end 18. The open end 18 having defined therein an encasement opening 20 which is formed by a sleeve type seam 22, which encircles the perimeter of the encasement opening 20. The sleeve seam 22 being formed by folding approximately 1.5 inches of material from the open end 18 and sewing a seam. The seam 22 having an elastic band 40, about 45 inches in length, disposed within the entire length of the seam 22. The encasement opening 20 closes about the inserted mattress in a fashion that would be expected from an elastic band. Top panel 12 having a communicating edge 24 at its open end 18 with a rectangular flap 26 extending outwardly therefrom, such as to extend over encasement opening 20 for closing thereof and thereby preventing exiting of a mattress 8 retained within a mattress receiving chamber 34. FIGS. 1 and 2 show the flap 26 in the open position. The elastic band 40 could also be sewn directly to the unelastic fabric as in other conventional methods, such as stitching its full length while sewing it to the unelastic fabric with unelastic thread. The main inventive concept would remain intact. The elastic band 40 is made of conventional materials that are well known to those skilled in the art for like applications.

FIG. 2 is a top perspective view of the crib sheet 10, shown with flap 26 pulled back and mattress 8 partially inserted. Flap 26 includes two sides 28 substantially parallel to each other at communicating edge 24, sides 28 extending in parallel relationship to each other and towards a distal end 30 of flap 26. Flap 26 having an inner surface 32. At an area of close proximity to its distal end 30, and on the inner surface 32 of flap 26, is a releasably attaching hook and loop closure strip 36, consisting of numerous small resilient and flexible hook-like elements integrally disposed upon the hook strip 36. Located on the bottom panel 14 is a releasable attaching hook and loop closure section 38, comprising a layer of curly piling material such as marketed under the Velcro trademark, and which is disposed upon the bottom panel 14 and adapted to cooperate with the hook and loop fastening strip 36, whereby the flap 26 can be draped and pulled downwardly from the open end 18 of the top panel 12 to close over the encasement opening 20 to form a releasable attachment. As with all hook and loop fasteners, only a mininum amount of pressure is required yet the closure is extremely secure. Important considerations in the use of hook and loop fasteners is their durability to withstand numerous washings, their resistance to damage by repeated securing operations, and that they will not readily adhere to other materials normally used as bedding materials.

Figure 4:
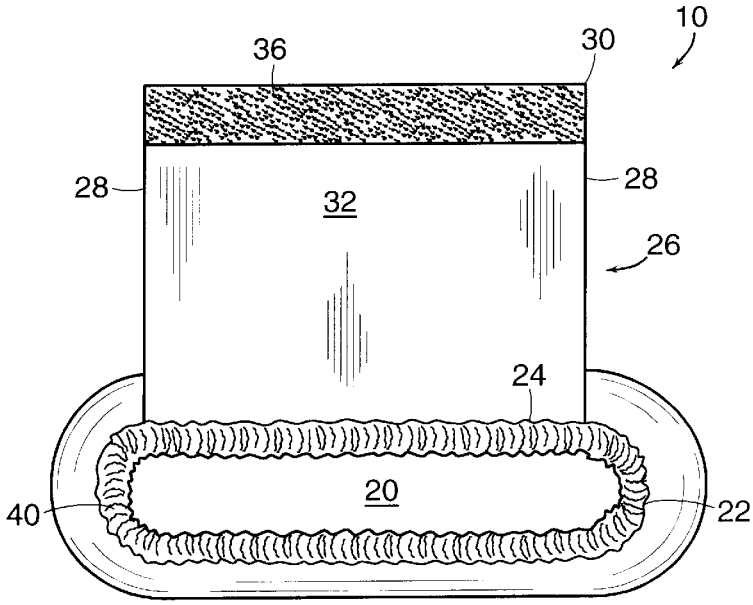
FIG. 4 is a top perspective view of the crib sheet with the mattress inside, the elastic seam pulled over the mattress and the flap in the open position.

FIG. 4 is an end view from the open end 18 of sheet 10 with mattress 8 disposally encased within sheet 10 and flap 26 being left open. As previously stated, sheet 10 is placed on mattress 8 in a similar manner as pulling a pillow case over a pillow. Sheet 10 has the elastic band 40 contained within a sleeve seam 22 sewn around encasement opening 20 of sheet 10. Encasement opening 20 being pulled over mattress 8 to provide for a tight, taut and secure fit, making it virtually impossible for a small child to pull sheet 10 off mattress 8. Sheet 10 thus being securely fastened by hook and loop closure means 36 and 38.

For purposes of the present invention, the crib sheet 10 disclosed herein is understood to be manufactured primarily from textile materials such as (but not limited to) cotton, nylon, cotton blend and flannel.

The crib sheet 10 of the present invention cannot be easily pulled off of the mattress 8 by a child and can be easily made due to its simplicity of configuration, and can be secured about the mattress 8 simply, easily and quickly without snagging.

The dimensions of crib mattresses are standardized by the ATME and the dimensions of the present invention are adapted for fitted disposition over the top, sides, ends and corners of these mattresses. The measurements of the panels 12 and 14 prior to seaming are approximately 58.5 by 34 inches. The flap 26 is approximately 23 by 14.5 inches. The strip of hook and loop material 36 is about 0.75 by 22 inches and is attached to an area of close proximity to the distal end 30 of the flap 26. The cooperating hook and loop material 38 is 12 by 22 inches with the 22 inch end adjoining the open end 18 of the bottom panel 14.

It will therefore be readily understood by those persons skilled in the art that the present invention is susceptible of broad utility and application. Many embodiments and adaptations of the present invention other than that herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be constued to limit the present invention or otherwise to exclude any such other embodiments, adaptations, variations, modifications and equivalent arrangements, the present invention being limited only by the claims appended hereto and equivalents thereof.

We claim:

1. A crib sheet for a substantially rectangular crib mattress, said crib sheet comprising:

a generally rectangular top panel and a generally rectangular bottom panel configured to define a mattress receiving chamber therein for receiving the mattress;

said crib sheet having a closed end and an open end, said open end having defined therein an encasement opening;

a sleeve seam formed about perimeter of said encasement opening, a continuous elastic band longitudinally disposed within said seam;

a communicating edge extending along said open end of said top panel;

a substantially rectangular flap, having parallel sides extending outwardly from said communicating edge, means for enclosing said flap to said bottom panel, whereby, said sheet may be pulled over the mattress with the mattress passing through said encasement opening to said receiving chamber, said elastic band constricting about the mattress to secure it within said sheet, said flap draped and pulled over mattress end, said flap having closure means to prevent a child from pulling said sheet free from the mattress.

2. The crib sheet according to claim 1, wherein the closure means includes:

said flap having a distal end in a spatial relationship from said communicating edge;

said flap having an inner surface;

a strip of releasably attaching hook and loop closure material disposed on said inner surface of said flap in an area of close proximity to said distal end; and a generally rectangular section of releasably attaching hook and loop closure material disposed on said bottom panel in an area of close proximity to said open end, for adapting to cooperate with said strip of hook and loop closure materials of said flap, whereby said sheet can be closed over the mattress by drapingly pulling said flap over the mattress end and pressing the hook and loop closure means together.

3. The crib sheet according to claim 2, wherein the strip of releasably attaching hook and loop closure material includes numerous small resilient and flexible hook-like elements integrally disposed upon said strip, said strip being approximately 0.75 by 22 inches.

4. The crib sheet according to claim 3, wherein the section of releasably attaching hook and loop closure material includes a layer of curly piling material integrally disposed upon said section, said section being about 12 by 22 inches.

5. The crib sheet according to claim 1, wherein the rectangular top and bottom panels include a pair of lateral edges approximately 33 inches in length and a pair of longitudinal edges approximately 56.5 inches in length.

6. The crib sheet according to claim 5, wherein the flap includes said distal end being approximately 24 inches in length and said parallel sides being approximately 15 inches in length.

7. The crib sheet according to claim 6, wherein the sleeve seam is formed by folding approximately 1.5 inches of material from said top and bottom panels and sewing a seam therein to create a hollow sleeve for passage of said elastic band.

8. The crib sheet according to claim 7, wherein the continuous elastic band measures approximately 45 inches.

9. A safety method of enclosing a crib mattress within a crib sheet comprising:

providing a rectangular crib sheet closed on three sides with an encasement opening extending along the length of the fourth side for permitting insertion of the mattress therethrough, said crib sheet having a top panel and a bottom panel, said top panel having a communicating edge extending along said encasement opening;

providing a sleeve seam formed about the perimeter of said encasement opening, a continuous elastic band disposed through said seam for constricting said encasement opening about the mattress;

extending outwardly from said communicating edge a generally rectangular flap having a distal end and an inner surface;

attaching hook and loop closure means, said hook portion of said closure means being integral with said inner surface of said flap in close proximity to said distal end, said loop portion being integral with said bottom panel in close proximity to said encasement opening; and inserting the mattress through said elastic band of said encasement opening, the mattress having a length and width slightly smaller than the length and width of said crib sheet, whereby the mattress can be enclosed within said crib sheet by draping and pulling said flap over end of the mattress and securely closing by pressing cooperating hook and loop material together.

10. The method according to claim 9, wherein the top and bottom panels include a pair of lateral edges approximately 33 inches in length and a pair of longitudinal edges approximately 56.5 inches in length.

11. The method according to claim 10, wherein the hook portion of the closure means comprises a strip approximately 0.75 by 22 inches having numerous small resilient and flexible hook-like elements integrally disposed thereupon.

12. The method according to claim 11, wherein the loop portion comprises a rectangular section approximately 12 by 22 inches having a layer of curly piling material integrally disposed thereupon.

13. The method according to claim 12, wherein the flap comprises parallel sides being approximately 15 inches in length, said distal end being approximately 24 inches in length.

14. The method according to claim 13, wherein the sleeve seam is formed by folding approximately 1.5 inches of material from said top and bottom panels for sewing a seam therein to provide a hollow sleeve for passage of said elastic band.

15. The method according to claim 14, wherein the continuous elastic band measures approximately 45 inches.

| LEGEND | |
|---|---|
| 8 | Crib Mattress |
| 10 | Crib Sheet |
| 12 | Top Panel |
| 14 | Bottom Panel |
| 16 | Closed end |
| 18 | Open end |
| 20 | Encasement opening |
| 22 | Sleeve seam |
| 24 | Communicating edge |
| 26 | Flap |
| 28 | Sides of flap (2) |
| 30 | Distal end of flap |
| 32 | Inner surface of flap |
| 34 | Mattress Receiving Chamber |
| 36 | Hook and Loop closure material with hook elements |
| 38 | Hook and Loop closure material with loop elements |
| 40 | Elastic band disposed within sleeve seam |

* * * * *